US007572135B2

(12) United States Patent
Kozono et al.

(10) Patent No.: US 7,572,135 B2
(45) Date of Patent: Aug. 11, 2009

(54) CONNECTOR

(75) Inventors: Seiji Kozono, Makinohara (JP); Takashi Matsunaga, Makinohara (JP); Hiroshi Kobayashi, Toyota (JP); Masato Minakata, Toyota (JP); Atsushi Nishida, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/395,308

(22) Filed: Apr. 3, 2006

(65) Prior Publication Data

US 2006/0240716 A1 Oct. 26, 2006

(30) Foreign Application Priority Data

Apr. 1, 2005 (JP) ..... P2005-106361

(51) Int. Cl.
*H01R 13/64* (2006.01)

(52) U.S. Cl. ..... 439/248

(58) Field of Classification Search ..... 439/246–249
See application file for complete search history.

(56) References Cited

U.S. PATENT DOCUMENTS 3,562,696 A * 2/1971 Barnhart et al. ..... 439/248
4,580,862 A * 4/1986 Johnson ..... 439/248

FOREIGN PATENT DOCUMENTS

JP 2002-198127 A 7/2002
JP 2002-246106 A 8/2002
JP 2004-281370 A 10/2004

* cited by examiner

*Primary Examiner*—Felix O Figueroa
(74) *Attorney, Agent, or Firm*—Sughrue Mion, PLLC

(57) ABSTRACT

A connector includes a female connector housing, that has a male terminal, and a male connector housing that has a female terminal for electrical connecting to the male terminal, and that is adapted to be fitted into the female connector. The male connector housing includes an inner housing which has the female terminal, and which is adapted to be fitted in the female connector housing so that the female terminal is connected to the male terminal, and an outer housing which is adapted to support the inner housing so that the inner housing is movable in a first direction in which the inner housing is fitted in the female connector housing and in a second direction perpendicular to the first direction. When the inner housing is fitted into the female connector housing, the inner housing is disposed so as to separate from the outer housing in the second direction with a first gap.

4 Claims, 5 Drawing Sheets

CONNECTOR

BACKGROUND OF THE INVENTION

This invention relates to a connector for electrically connecting female and male terminals together, and more particularly to a connector in which wear of contact portions of the female and male terminals due to vibration is reduced.

A connector, used, for example, in the wiring of a vehicle such as an automobile, undergoes vibration developing during the travel of the vehicle, and contact portions of female and male terminals are worn by such vibration, and in some cases the electrical connection becomes defective. Therefore, there is known a conventional connector in which relative motion between female and male connector housings, fitted together, is suppressed so as to reduce wear of contact portions of female and male terminals which rub against each other (see, for example, JP-A-2002-198127 (Pages 3 to 4, FIGS. 4 and 6)).

As shown in FIGS. 5A and 5B, the connector 100, disclosed in JP-A-2002-198127, comprises the female connector housing 102 holding the male terminals 103, and the male connector housing 104 receiving the female terminals 101 for electrical connection to the respective male terminals 103. The male connector housing 104 includes an inner housing 106 which holds the female terminals 101, and is fitted into a hood portion 105 of the female connector housing 102, and an outer housing 107 of a generally square tubular shape formed around the inner housing 106. The male connector housing 104 is formed into an integral construction.

Limitation projections 108 are formed on an inner surface of the hood portion 15 of the female connector housing 102, and these limitation projections 108 contact an outer surface of the inner housing 106 of the male connector housing 104 inserted and fitted in the hood portion 105. As a result, relative motion of the female and male connector housings 102 and 104 in a direction perpendicular to the direction of fitting of these connector housings to each other is suppressed.

A lock arm 109 is formed on the outer housing 107 of the male connector housing 104, and this lock arm 109 is retainingly engaged with an engagement projection of the female connector housing 102. As a result, the rearward movement of the male connector housing 104 in the fitting direction is prevented, so that the fitted condition of the female and male connector housings 102 and 104 is maintained.

To reduce a load applied to the female and male terminals is effective in reducing wear of the contact portions of the female and male terminals due to vibration. However, in the connector 100 disclosed in JP-A-2002-198127, the inner housing 106 of the male connector housing 104, holding the female terminals 101, is formed integrally with the outer housing 107. Therefore, when vibration is applied to the connector 100, so that relative motion between the mutually-fitted female and male connector housings occurs, the overall weight of the male connector housing 104 is applied as a load directly to the female and male terminals 101 and 103.

And besides, the limitation projections 108 in the connector 100, disclosed in JP-A-2002-198127, suppress the relative motion in the direction perpendicular to the fitting direction, but is less effective in suppressing the relative motion in the fitting direction. As a result of this fact, along with the fact that the overall weight of the male connector housing 104 is applied as a load, there is a fear that wear of the female and male terminals 101 and 103 due to vibration is not sufficiently reduced.

Furthermore, when the limitation projections 108 in the connector 100, disclosed in JP-A-2002-198127, are used for a long period of time, there is a fear that these limitation projections 108 are worn by relative motion of the female and male connector housings 102 and 104 in the fitting direction, and there is also a fear that relative motion of the female and male connector housings 102 and 104 in the direction perpendicular to the fitting direction also occurs.

SUMMARY OF THE INVENTION

This invention has been made in view of the above problems, and an object of the invention is to provide a connector in which a load, applied to female and male terminals, can be reduced, and also relative motion of mutually-fitted female and male connector housings both in a fitting direction and in a direction perpendicular to the fitting direction can be suppressed, thereby reducing wear of contact portions of the female and male terminals.

The above object has been achieved by a connector of the present invention having features recited in the following Paragraphs (1) to (4).

(1) A connector, comprising:

a female connector housing, that has a male terminal; and a male connector housing that has a female terminal for electrical connecting to the male terminal, and that is adapted to be fitted into the female connector, wherein the male connector housing includes:

an inner housing which has the female terminal, and which is adapted to be fitted in the female connector housing so that the female terminal is connected to the male terminal; and an outer housing which is adapted to support the inner housing so that the inner housing is movable in a first direction in which the inner housing is fitted in the female connector housing and in a second direction perpendicular to the first direction; and wherein when the inner housing is fitted into the female connector housing, the inner housing is disposed so as to separate from the outer housing in the second direction with a first gap.

Preferably, when the inner housing is not fitted into the female connector housing, the inner housing contacts with the outer housing in the second direction or is separated from the outer housing with a second gap in the second direction. A width of the first gap is greater than that of the second gap.

(2) Preferably, a rib and a rib receiving portion are respectively formed on an outer surface of the inner housing and an inner surface of the outer housing which are opposed to each other in the second direction. When the inner housing is not fitted into the female connector housing, the rib contacts the rib reception portion, or is separated from the rib reception portion with the second gap. When the inner housing is fitted into the female connector housing, the rib is shifted away from the rib reception portion in the first direction so that the first gap is formed between the inner housing and the outer housing.

(3) Preferably, a first slanting surface is formed on the outer surface of the inner housing. A second slanting surface is formed on an inner surface of the female connector housing, and is corresponded to the first slanting surface. The first slanting surface is mated with the second slanting surface.

(4) Preferably, the connector further includes an urging unit that is interposed between the inner housing and the outer housing. When the inner housing is fitted into the female connector housing, the urging unit urges the inner housing in the first direction so that the first slanting surface of the inner housing is pressed against the second slanting surface of the female connector housing.

In the connector of the construction of the above Paragraph (1), the inner housing is supported by the outer housing in such a manner that the inner housing can move both in the first direction and in the second direction perpendicular to the first direction. Namely, the male connector housing is divided into the inner housing and the outer housing.

When the inner housing is not fitted into the female connector housing, the inner housing contacts the outer housing in the second direction perpendicular to the first direction, or is disposed in such a manner that the second gap is formed between the inner housing and the outer housing in the second direction perpendicular to the first direction. Therefore, during the operation for fitting the inner housing into the female connector housing, relative motion of the inner housing in the second direction is suppressed, and the inner housing can be smoothly fitted into the female connector housing.

When the inner housing is fitted in the female connector housing, the inner housing is disposed in such a manner that the first gap, being greater than the second gap, is formed between the inner housing and the outer housing in the second direction. Therefore, even when vibration acts on the connector, so that relative motion of the female and male connector housings occurs, the outer housing is prevented from interfering with the inner housing, and the load of the outer housing will not act on the female and male terminals. Therefore, the load, acting on the female and male terminals, is reduced, so that the load, acting on contact portions of these terminals, can be reduced.

In the connector of the construction of the above Paragraph (2), during the operation for fitting the inner housing into the female connector housing, the inner housing is moved in the first direction, and by doing so, the rib of the inner housing is displaced in the fitting direction, and is completely brought out of registry with the corresponding rib reception portion of the outer housing. As a result, a gap, corresponding to a height of the rib reception portion, is formed between the rib and the inner surface of the outer housing, and also a gap, corresponding to a height of the rib, is formed between the rib reception portion and the outer surface of the inner housing. With this simple construction, when the inner housing is not fitted in the female connector housing, the inner housing contacts the outer housing in the second direction, or is disposed in such a manner that the second gap is formed between the inner housing and the outer housing in the direction perpendicular to the fitting direction. Also, when the inner housing is fitted in the female connector housing, the inner housing is disposed in such a manner that the first gap, larger than the second gap, is formed between the inner housing and the outer housing in the second direction perpendicular to the first direction.

In the connector of the construction of the above Paragraph (3), the first slanting surface is formed on the outer surface of the inner housing, and the second slanting surface is formed on the inner surface of the female connector housing, and the first slanting surface is mated with the second slanting surface. These slanting surfaces intersect the first direction, and therefore relative motion of the inner housing and the female connector housing (which are fitted together) both in the fitting direction and in the second direction perpendicular to the fitting direction can be suppressed. Furthermore, when the mating slanting surfaces are worn, the inner housing is inserted deeper into the female connector housing, so that the first slanting surface is kept mated respectively with the second slanting surface, and therefore the relative motion can be suppressed for a long period of time.

In the connector of the construction of the above Paragraph (4), the urging unit, interposed between the inner housing and the outer housing, urges the inner housing in the first direction in such a manner that the slanting surface of the inner housing is pressed against the slanting surface of the female connector housing. With this construction, the slanting surface of the inner housing is always positively kept mated with the slanting surface of the female connector housing, and therefore relative motion of the inner housing and the female connector housing (which are fitted together) both in the first direction and in the second direction perpendicular to the first direction can be positively suppressed. A member, having spring properties, can suitably be used as the urging unit, and one example is a coil spring.

In the connector of the present invention, a load, applied to the female and male terminals, can be reduced, and also relative motion of the mutually-fitted female and male connector housings both in the first direction and in the second direction perpendicular to the first direction can be suppressed, thereby reducing wear of the contact portions of the female and male terminals.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of a connector of the present invention will now be described in detail with reference to the drawings.

Figure 1:
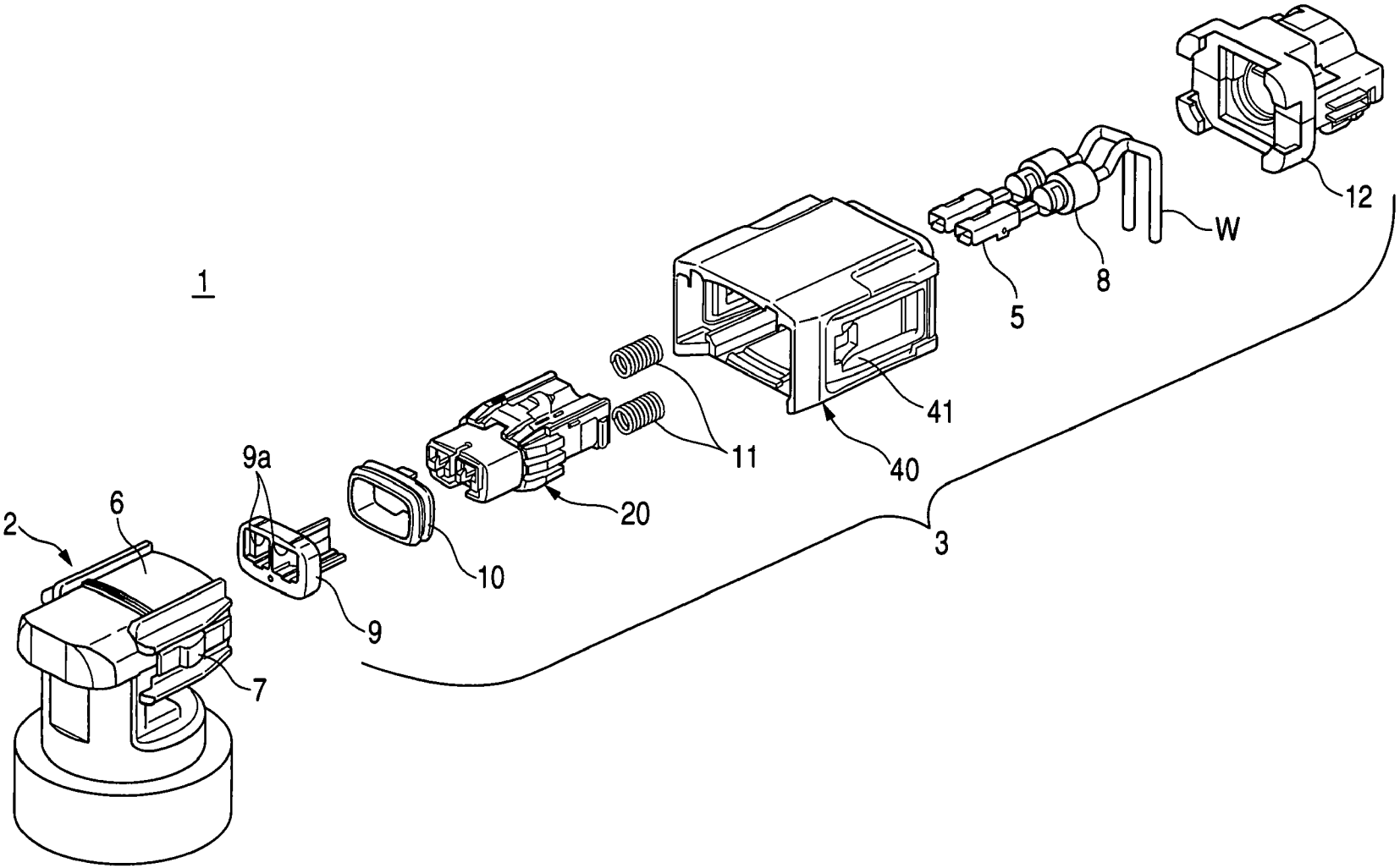
FIG. 1 is an exploded, perspective view of one preferred embodiment of a connector of the present invention.
Figure 2:
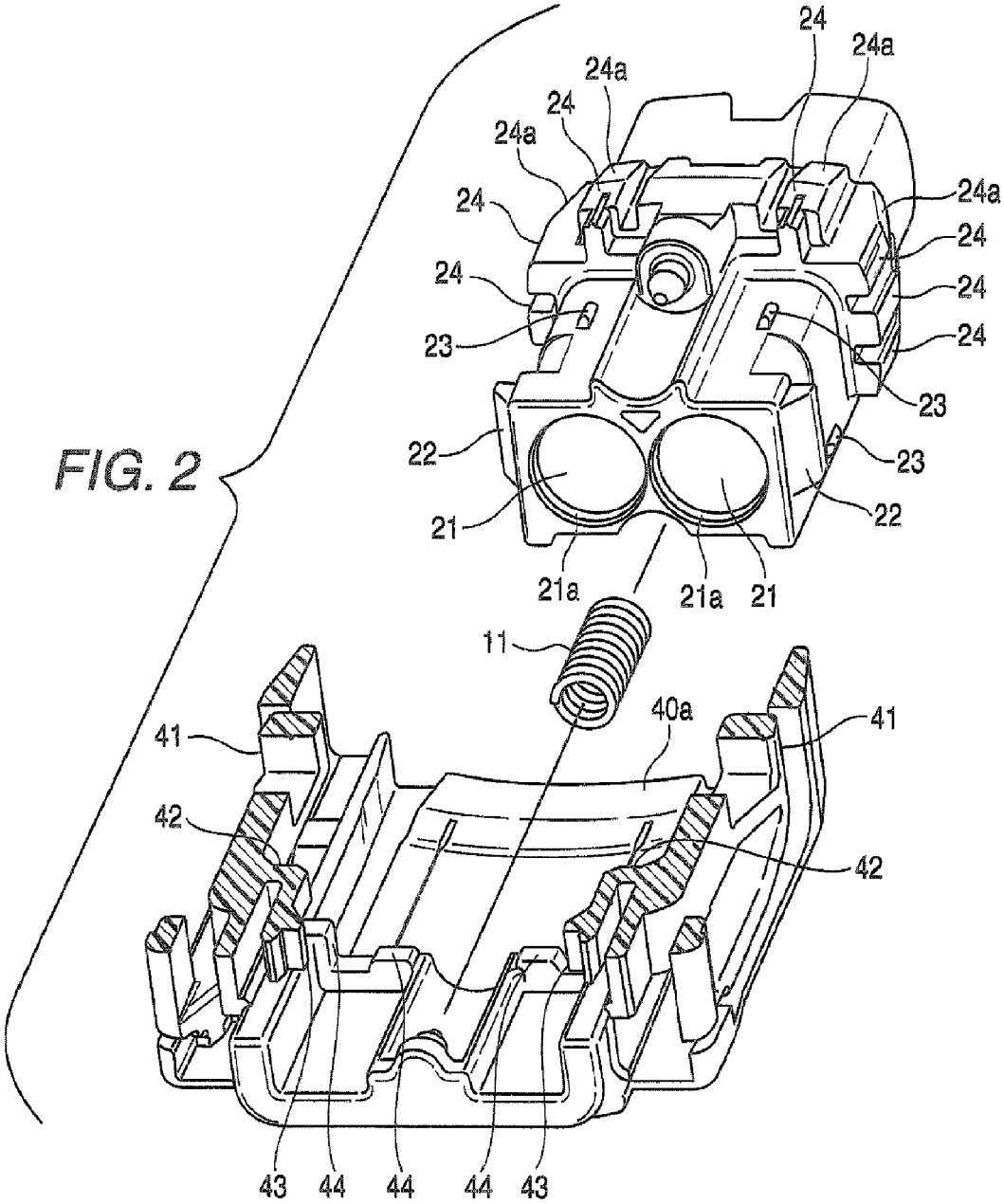
FIG. 2 is a perspective view showing an inner housing and an outer housing of a male connector housing, with the outer housing shown as being partly broken.
Figure 3A:
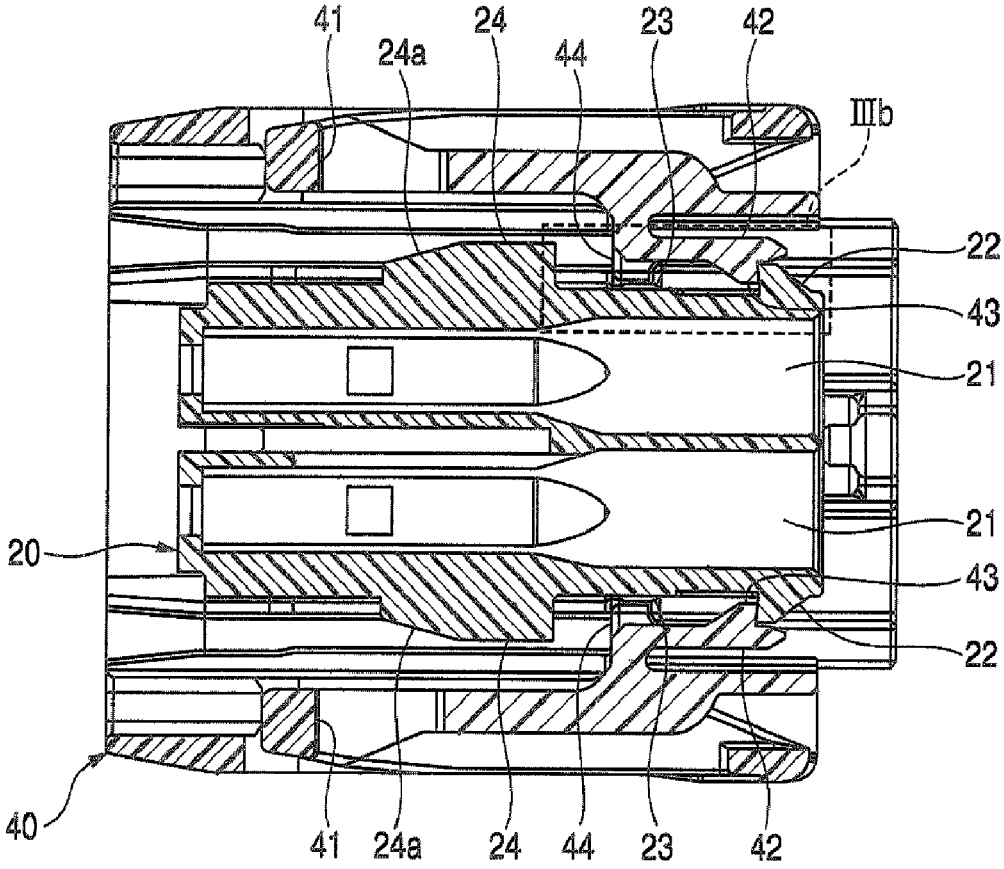
FIG. 3A is a cross-sectional view of the male connector housing which is not fitted in a female connector housing.
Figure 3B:
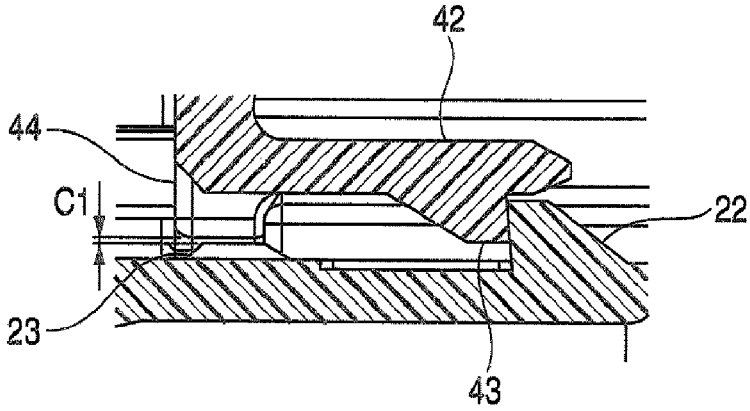
FIG. 3B is an enlarged view of a portion surrounded by a broken line IIIb of FIG. 3A.
Figure 4A:
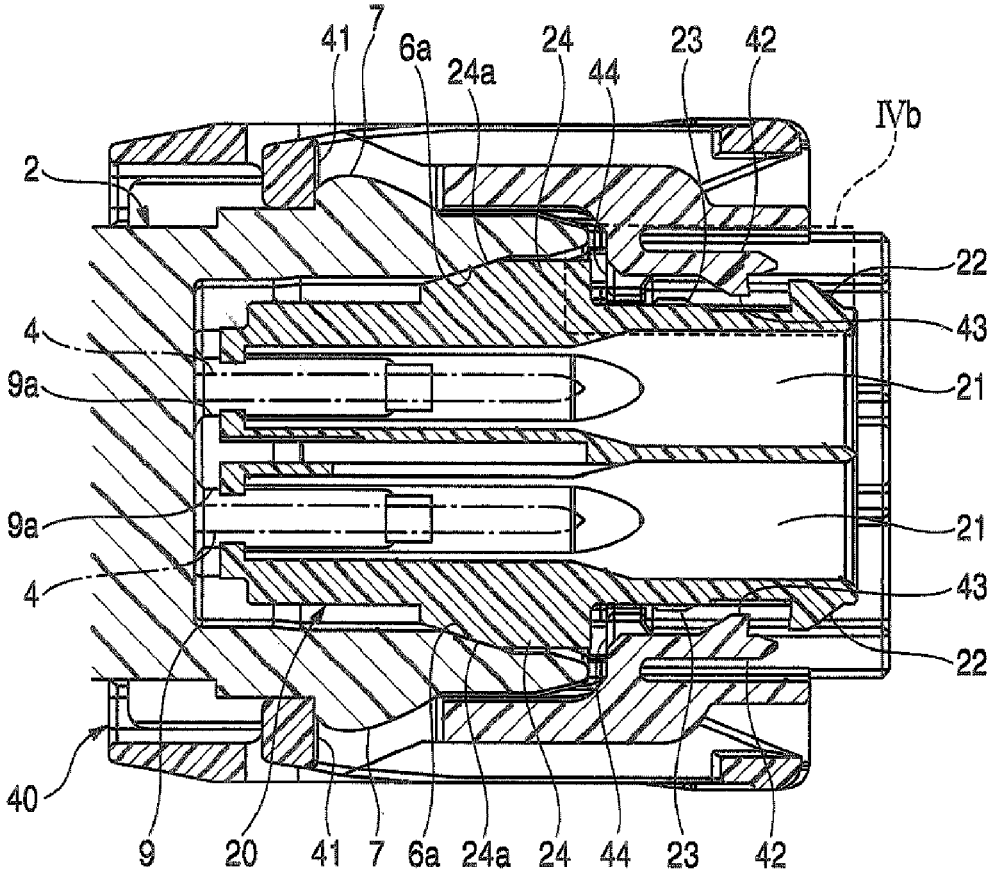
FIG. 4A is a cross-sectional view of the male connector housing fitted in the female connector housing.
Figure 4B:
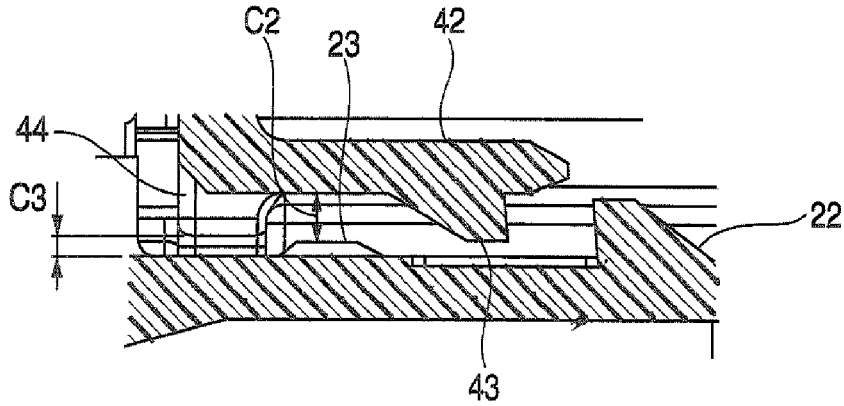
FIG. 4B is an enlarged view of a portion surrounded by a broken line IVb of FIG. 4A.
Figure 5A:
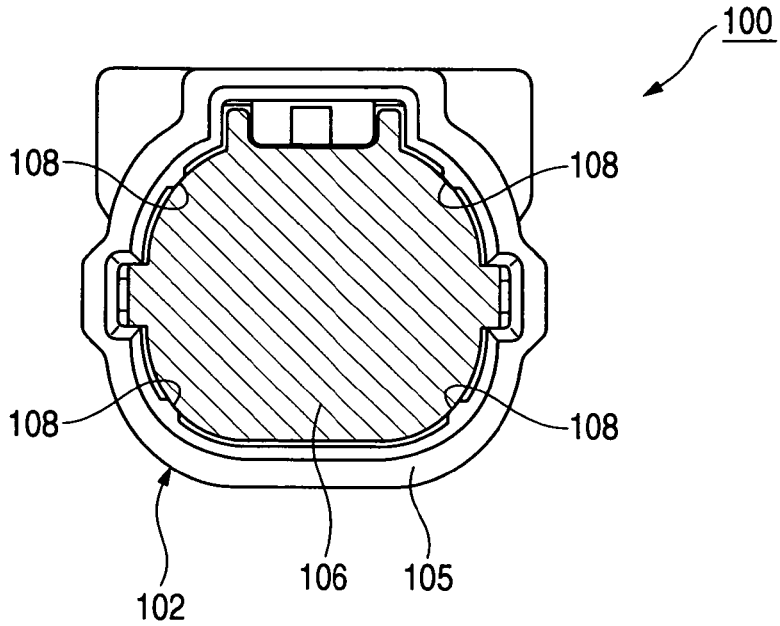
FIGS. 5A and 5B are cross-sectional views of a related connector.
Figure 5B:
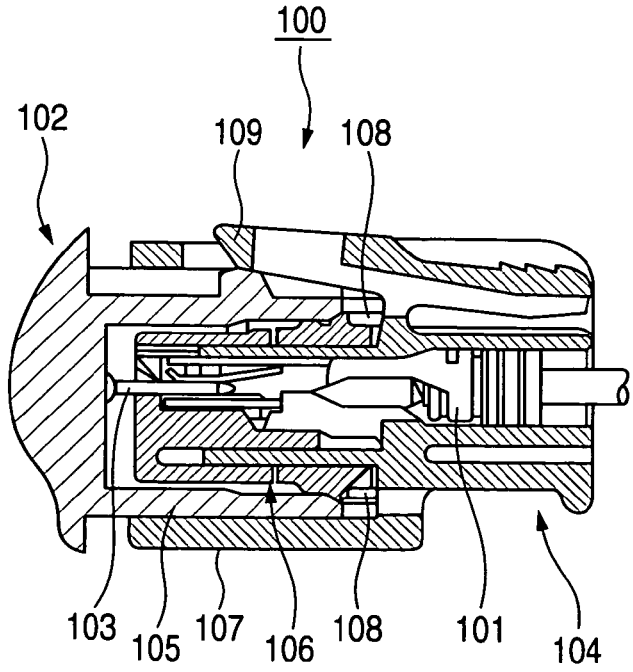

FIG. 1 is an exploded, perspective view of the connector of this embodiment, FIG. 2 is a perspective view showing an inner housing and an outer housing of a male connector housing, with the outer housing shown as been partly broken, FIG. 3A is a cross-sectional view of the male connector housing which is not fitted in a female connector housing, FIG. 3B is an enlarged view of a portion surrounded by a broken line IIIb of FIG. 3A, FIG. 4A is a cross-sectional view of the male connector housing fitted in the female connector housing, and FIG. 4B is an enlarged view of a portion surrounded by a broken line IVb of FIG. 4A.

As shown in FIG. 1, the connector 1 of this embodiment includes the female connector housing 2 which holds male terminals 4 (indicated by dot-and-dash lines in FIG. 4A), and the male connector housing 3 receiving female terminals 5 for electrical connection to the respective male terminals 4.

The female connector housing 2 is, for example, a resin-molded part in which the male terminals 4 are insert molded, and this female connector housing 2 is fixed to an equipment, and includes a hood portion 6 of a generally rectangular tubular shape surrounding the male terminals 4. A pair of retaining projections 7 for retaining engagement with respective retaining member formed on the outer housing of the male connector housing 3 (described later) are formed on an outer surface of the hood portion 6.

Referring to FIG. 2, the male connector housing 3 comprises the inner housing 20 which holds the female terminals 5, and can be fitted in the hood portion 6 of the female connector housing 2 so that the female terminals 5 can be connected to the respective male terminals 4 held by the female connector housing 2, and the outer housing 40 having a pair of lock arms 41 (serving as the retaining member) which are retainingly engaged with the respective engagement projections 7 of the female connector housing 2 when the inner housing 20 is fitted in the hood portion 6 of the female connector housing 2.

The inner housing 20 is, for example, a resin-molded part, and is formed into a generally square pillar-shape, and has terminal receiving chambers 21 for respectively receiving and holding the female terminals 5 each having a wire W connected thereto. The terminal receiving chambers 21 extend through the inner housing 20 from a rear end thereof to a front end thereof in a direction of fitting of the male and female connector housings 3 and 2 to each other. Each female terminal 5 is inserted into the corresponding terminal receiving chamber 21 from a rear opening 21*a* thereof.

An elastic member 8 of a waterproof nature such for example as a ring-like rubber packing is fitted on a rear end portion of the female terminal 5 to which the wire W is connected. The elastic member 8 is press-fitted into a rear end portion of the terminal receiving chamber 21, and is fixed thereto, thereby preventing the female terminal 5 from being withdrawn from the rear opening 21*a* of the terminal receiving chamber 21.

A front holder 9 is attached to the front end portion of the inner housing 20. The front holder 9 is held against front ends of the female terminals 5 received in the respective terminal receiving chambers 21, thereby preventing the female terminals 5 from being withdrawn from front openings of the respective terminal receiving chambers 21. Openings 9*a* are formed in the front holder 9, and the female terminals 5 are accessible from the exterior in the fitting direction through these openings 9*a*.

An elastic member 10 of a waterproof nature such for example as a ring-like rubber packing is fitted on the front end portion of the inner housing 20. When the inner housing 20 is fitted in the hood portion 6 of the female connector housing 2, the elastic member 10 is held in intimate contact with an inner surface of the hood portion 6 to form a waterproof seal, and also functions as a shock absorbing material for damping vibration transmitted between the hood portion 6 and the inner housing 20.

The outer housing 40 is, for example, a resin-molded part, and receives the inner housing 20 therein, and is formed into such a generally square tubular shape that the outer housing 40 surrounds the received inner housing 20, with a predetermined gap formed between its surface and the outer surface of the inner housing 20.

A pair of elastic retaining piece portions 42 are formed respectively on opposed inner side surfaces of the outer housing 40. The elastic retaining piece portion 42 has a generally L-shape, and its distal end portion extends rearwardly in the fitting direction, and its proximal end portion is integrally connected to the inner surface of the outer housing 40. A retaining projection 43 is formed at the distal end portion of the elastic retaining piece portion 42, and is directed toward the inside of the outer housing 40. A pair of engagement projections 22 for retaining engagement respectively with the pair of elastic retaining piece portions 42 are formed on and project from the outer surface of the rear end portion of the inner housing 20.

The inner housing 20 is inserted into the outer housing 40 through a front opening 40*a* of the outer housing 40. As the inner housing 20 is inserted into the outer housing 40, a rear end surface of each engagement projection 22 of the inner housing 20 is brought into abutting engagement with a front end surface of the retaining projection 43 of the corresponding elastic retaining piece portion 42 of the outer housing 40, and elastically deforms the elastic retaining piece portion 42 in a manner to move the distal end portion of the elastic retaining piece portion 42 toward the inner surface of the outer housing 40 to which the proximal end portion of the elastic retaining piece portion 42 is integrally connected. When the inner housing 20 reaches a predetermined position, the elastic retaining piece portion 42 slides past the engagement projection 22 of the inner housing 20, and is restored into its initial condition from the elastically-deformed condition, so that the retaining projection 43 is located at the front side of the engagement projection 22. In this condition in which the inner housing 20 is thus received in the outer housing 40, each elastic retaining piece portion 42 of the outer housing 40 is retainingly engaged at the rear end surface of its retaining projection 43 with the front end surface of the corresponding engagement projection 22 of the inner housing 20.

Coil springs 11 (made of metal), serving as urging members, are interposed between the inner housing 20 and the outer housing 40. The coil springs 11 are so arranged as to be expanded and contracted in a direction coinciding with the fitting direction, and these coil springs 11 resiliently urge the inner housing 20 forwardly in the fitting direction relative to the outer housing 40. As described above, the engagement projections 22 of the inner housing 20 are retained respectively by the elastic retaining piece portions 42 of the outer housing 40, and therefore the inner housing 20 is prevented from being withdrawn from the front opening 40*a* of the outer housing 40.

A rear cover 12 is mounted in a rear opening of the outer housing 40 to close this rear opening, and the wires W, connected respectively to the female terminals 5 held in the inner housing 20, can be led to the exterior through the rear cover 12.

The structure of fitting the female connector housing 2 and the male connector housing 3 together will be described with reference to FIGS. 3 and 4.

FIG. 3A is a cross-sectional view showing the male connector housing 3 in its non-fitted condition in which the male connector housing 3 is not fitted in the female connector housing 2. In this non-fitted condition, the inner housing 20 is resiliently urged forwardly in the fitting direction by the coil springs 11, and is received within the outer housing 10, with the engagement projections 22 retained by the respective elastic retaining piece portions 42 of the outer housing 40.

A plurality of ribs 23 and a plurality of rib reception portions 44 are formed respectively on the outer surface of the inner housing 20 and the inner surface of the outer housing 40 which are opposed to each other in a direction perpendicular to the fitting direction, and each rib 23 and the corresponding rib reception portion 44 project toward each other. In order that the inner housing 20 can be smoothly inserted into the outer housing 40, a clearance (small gap) C1 is formed between each rib 23 and the corresponding rib reception portion 44 as shown in FIG. 3B. The inner housing 20, received within the outer housing 40, is contacted at the ribs 23 with the rib reception portions 44 of the outer housing 40, or is disposed in such a manner that the clearance C1 is formed between each rib 23 and the corresponding rib reception portion 44. This inner housing 20 is resiliently urged by the coil spring 11, and is supported by the outer housing 40 in such a manner that the inner housing 20 will not move relative to the outer housing 40 in a direction perpendicular to the fitting direction, and can move forward and rearward in the fitting direction.

A plurality of limitation projections 24 are formed on the outer surface of the front end portion of the inner housing 20, and are arranged generally symmetrically with respect to a centerline (or axis) of the inner housing 20. A front end surface 24*a* of each of the limitation projections 24 is defined by a slanting surface which is slanting forwardly in the fitting direction in a manner to gradually approach the centerline of the inner housing 20. Slanting surfaces 6*a* which can be mated respectively with (or held in surface-to-surface contact with) the slanting surfaces 24*a* of the limitation projections 24 of the inner housing 20 are formed on an inner surface of the opening of the hood portion 6 of the female connector housing 2.

As the male connector housing 3 is moved to be fitted into the female connector housing 2, the inner housing 20 of the male connector housing 3 is fitted into the hood portion 6 of the female connector housing 2. At this time, the hood portion 6 of the female connector housing 2 enters a space between the outer surface of the inner housing 20 of the male connector housing 3 and the inner surface of the outer housing 40 thereof. Then, the slanting surfaces 24*a* of the limitation projections 24 of the inner housing 20 are mated respectively with the slanting surfaces 6*a* of the hood portion 6, so that the position of the inner housing 20 relative to the female connector housing 2 is fixed.

FIG. 4A shows the male connector housing 3 fitted in the female connector housing 2. At the time when the male connector housing 3 is completely fitted in the female connector housing 2, the hood portion 6 of the female connector housing 2 further enters the space between the outer surface of the inner housing 20 of the male connector housing 3 and the inner surface of the outer housing 40 thereof, and the engagement projections 7, formed on the outer surface of the hood portion 6, are retainingly engaged with the lock arms 41 of the outer housing 40. The inner housing 20, fixed to the female connector housing 2, is moved rearward in the fitting direction relative to the outer housing 40 by an amount larger than an amount of superimposing of each rib 23 and the corresponding rib reception portion 44 on each other in the fitting direction.

In this fitted condition, the inner housing 20 and the outer housing 40 are supported by the hood portion 6 of the female connector housing 2 independently of each other. And, the inner housing 20 is moved rearward in the fitting direction relative to the outer housing 40 as described above, and by doing so, each rib 23 of the inner housing 20 is displaced in the fitting direction, and is completely brought out of registry with the corresponding rib reception portion 44. As a result, a gap C2, corresponding to a height of the rib reception portion 44, is formed between the rib 23 and the inner surface of the outer housing 40, and also a gap C3, corresponding to a height of the rib 23, is formed between the rib reception portion 44 and the outer surface of the inner housing 20 as shown in FIG. 4B. Both of the gap C2 and the gap C3 are larger than the clearance C1, and therefore in this condition, a larger gap is formed between the inner housing 20 and the outer housing 40 than in the non-fitted condition of the male connector housing 3 (in which it is not fitted in the female connector housing 2).

Thus, the inner housing 20, holding the female terminals 5, is disposed out of contact with the outer housing 40, and therefore even when vibration is applied to the connector 1, so that relative motion of the female and male connector housings 2 and 3 occurs, the load of the outer housing 40 will not act on the male and female terminals 4 and 5. As a result, a load, acting on the male and female terminals 4 and 5, is reduced, thereby reducing wear of contact portions of these terminals.

And besides, the slanting surfaces 24 formed respectively on the limitation projections 24 of the inner housing 20, as well as the slanting surfaces 6*a* formed on the hood portion 6 of the female connector housing 2, intersect the fitting direction, and therefore relative motion of the inner housing 20 and the female connector housing 2 (which are fitted together) both in the fitting direction and in a direction perpendicular to the fitting direction is suppressed. Furthermore, when the mating slanting surfaces 24*a* and 6*a* are worn, the inner housing 20 is inserted deeper into the female connector housing 2, so that the slanting surfaces 24*a* are kept mated with the respective slanting surfaces 6*a*, and therefore the relative motion is suppressed for a long period of time.

Furthermore, the coil springs 11 resiliently urge the inner housing 20 forwardly in the fitting direction in such a manner that the slanting surfaces 24*a*, formed respectively on the limitation projections 24 of the inner housing 20, are pressed respectively against the slanting surfaces 6*a* formed on the hood portion 6 of the female connector housing 2. With this construction, the slanting surfaces 24*a*, formed respectively on the limitation projections 24 of the inner housing 20, are always positively kept mated respectively with the slanting surfaces 6*a* formed on the hood portion 6 of the female connector housing 2, and therefore relative motion of the inner housing 20 and the female connector housing 2 (which are fitted together) both in the fitting direction and in the direction perpendicular to the fitting direction is positively suppressed.

The present invention is not limited to the above embodiment, and suitable modifications, improvements and so on can be made.

The present application is based on Japan Patent Application No. 2005-106361 filed on Apr. 1, 2005, the contents of which are incorporated herein for reference.

What is claimed is:

1. A connector, comprising:

a female connector housing, that has a male terminal; and a male connector housing that has a female terminal for electrical connecting to the male terminal, and that is adapted to be fitted into the female connector housing, wherein the male connector housing includes:

an inner housing which has the female terminal, and which is adapted to be fitted in the female connector housing so that the female terminal is connected to the male terminal; and an outer housing which is adapted to support the inner housing so that the inner housing is movable with respect to the outer housing in a first direction in which the inner housing is fitted in the female connector housing and is movable in a second direction perpendicular to the first direction;

wherein when the inner housing is fitted into the female connector housing, the entire inner housing is disposed so as to be isolated from the outer housing in the second direction;

wherein a rib and a rib receiving portion are respectively formed on an outer surface of the inner housing and an inner surface of the outer housing which are opposed to each other in the second direction;

wherein when the inner housing is not fitted into the female connector housing, the rib opposes the rib receiving portion in the second direction so that the rib overlaps with the rib receiving portion in the second direction preventing the inner housing from moving relative to the outer housing in the second direction; and wherein when the inner housing is fitted into the female connector housing, the rib is shifted away from the rib receiving portion in the first direction so as not to overlap with the rib receiving portion in the second direction, so that a gap is formed between the inner housing and the outer housing thereby allowing the inner housing to move relative to the outer housing in the second direction only when in the inner housing is fitted into the female connector housing.

2. The connector according to claim 1, wherein a first slanting surface is formed on the outer surface of the inner housing;

wherein a second slanting surface is formed on an inner surface of the female connector housing, and is corresponded to the first slanting surface; and wherein the first slanting surface is mated with the second slanting surface.

3. The connector according to claim 2, further comprising an urging unit that is interposed between the inner housing and the outer housing, wherein when the inner housing is fitted into the female connector housing, the urging unit urges the inner housing in the first direction so that the first slanting surface of the inner housing is pressed against the second slanting surface of the female connector housing.

4. The connector according to claim 1, wherein when the inner housing is fitted into the female connector housing, a portion of the female connector housing enters a space between the outer surface of the inner housing and the inner surface of the outer housing so that the inner housing becomes fixed in the position with respect to the female connector housing, thereby forcing the inner housing and the outer housing to move from a contacting condition to a non-contacting condition.

* * * * *